United States Patent [19]

Gerhards et al.

[11] 4,022,049

[45] May 10, 1977

[54] ROLLING MILLS

[75] Inventors: Hans Dieter Gerhards, Solingen-Grafrath; Hermann Möltner, Dusseldorf-Oberkassel, both of Germany

[73] Assignee: Firma Friedrich Kocks, Dusseldorf, Germany

[22] Filed: July 16, 1975

[21] Appl. No.: 596,394

[30] Foreign Application Priority Data

Aug. 29, 1974 Germany ..... 2441337

[52] U.S. Cl. ..... 72/234; 72/365

[51] Int. Cl.[2] ..... B21B 17/00

[58] Field of Search ..... 72/234, 235, 199, 226, 72/366, 204, 365

[56] References Cited

UNITED STATES PATENTS

| | | | |
|---|---|---|---|
| 1,946,240 | 2/1934 | Rohn | 72/234 X |
| 1,980,368 | 11/1934 | Bark et al. | 72/234 X |
| 2,085,968 | 7/1937 | Gassen | 72/241 X |
| 3,726,119 | 4/1973 | Bindernagel | 72/234 |

*Primary Examiner*—Milton S. Mehr

*Attorney, Agent, or Firm*—Buell, Blenko & Ziesenheim

[57] ABSTRACT

An improved rolling mill capable of both stretch reducing tubes having relatively small external diameters and of reducing tubes having relatively large external diameters is provided having a plurality of successive roller stands some stands having small roll diameters and other stands having large roll diameters, the said other stands having large roll diameters being arranged to follow, in the direction of rolling, the said some stands having small roll diameters so that said other stands are at the exit end of the rolling mill.

3 Claims, No Drawings

ROLLING MILLS

This invention relates to improved rolling mills and paricularly to a rolling mill for the stretch-reducing of tubes having relatively small external diameters, and for the reducing of tubes having relatively large external diameters.

There are, in general, two possible solutions if it is required to stretch-reduce tubes having relatively small external diameters, for example less than 130 mm, by a considerable amount to an external diameter of, for example, 50 mm and less, and also if it is required to reduce or roll to size tubes having relatively large external diameters, for example from 130 to 220 mm, by only a few millimeters, for example by 3 to 10 mm.

Firstly, a stretch-reducing rolling line can be constructed to stretch-reduce the small tubes, and a separate rolling line can be constructed to reduce and size-roll the large tubes. This solution, requiring two complete rolling lines together with their drives, is very expensive with respect to capital expenditure and operating costs. Furthermore, it requires a correspondingly large amount of floor area.

Secondly, a rolling mill can be constructed which is suitable for the stretch-reducing of small tubes as well as for reducing and size-rolling larger tubes. Since, for example, only approximately three or four stands are required for the reducing of the larger tubes, and since the demand for a stretch-reducing operation requiring a far larger number of stands, for example eighteen stands, substantially exists only in the case of small tube diameters, a rolling mill of this type has only a few, for example three or four, stands having a large roller diameter and a substantially larger number, for example fourteen or fifteen, stands having smaller roller diameters.

The use of the few large stands having large roller diameters is sufficient for reducing and size-rolling the large tubes, the small stands having small roller diameters being taken out of the rolling line, so that their small sizing passes do not obstruct the passage of the tubes. However, all the stands, at least almost all the stands, have to be used for the stretch-reducing of the small tubes, the existing large stands also being jointly used for the stretch-reducing of the small tubes, so that, in total, the rolling mill is not provided with more stand locations than are required for the longest row of sizing passes when sretch-reducing. To obtain the long row of sizing passes for stretch-reducing, the stands, required in addition to the existing large stands used for reducing, are in the form of stands having small roller diameters, since large tubes do not need to be stretch-reduced, and, in these circumstances, the use of further large stands is not only unnecessary but is even disadvantageous owing to the higher capital expenditure, the higher operating costs, the increased spatial requirements, and the larger distances between the stands which result in the longer, unserviceable, thickened ends. Consequently, in this second solution, a rolling mill is provided which has small and large stands, wherein the individual stand locations can be dimensioned either only for a small or only for a large stand owing to the connection for coupling dimensions and rotational speeds, so that large and small stands cannot be optionally interchanged at the individual stand locations. Rolling mills of this type are known.

In the known rolling mills of this type, the large stands having the large roller diameters are arranged at the front stand locations in the rolling direction, since the workpiece to be rolled always has the largest cross section at this location. However, this stand arrangement is disadvantageous, since it results in the production of particularly long thickened ends which are unusable so that the proportion of waste or scrap is correspondingly high relative to the production quantity. The reason for the elongation of the thickened ends is that its length is determined by the distance between the stands as the most essential factor with distance, namely primarily the distance between those stands in which the tension is built up for stretching the workpiece and in which, or between which, the largest quantity of work-material is located during rolling. Both apply to the stands which are in front in the rolling direction. Since these stands are the largest stands of the rolling mill in the known construction of the prior art, and they are thus spaced at the greatest distances apart, this is the reason why the longest, unusable thickened ends are also produced in the known rolling mill of this type.

A feature of the present invention is to provide a rolling mill for the purpose described initially in which the above disadvantages are substantially avoided and which also operates in a technically improved and more economical manner.

The invention provides a rolling mill both for the stretch-reducing of tubes having relatively small external diameters, and for the reducing of tubes having relatively large external diameters, which rolling mill comprises roller stands having small and large roller diameters, the roller stands having the larger roller diameters being arranged at the stand locations which are at the rear in the rolling direction, precisely opposite the prior art practices.

Thus, the front stands receive the smaller roller diameters during stretch-reducing, and thus the front stands are spaced at the shorter distances apart. Advantageously, the thickened ends are rendered shorter, and the proportion of waste relative to output is correspondingly reduced, by virtue of the fact that the front stands which build up the tension are spaced at the shorter distances apart and at the same time contain the largest quantity of work-material during the rolling operation. The larger roller stands can no longer elongate the thickened ends at the rear stand locations, since the quantity of work-material contained therein is smaller, so that they alone cannot have any detrimental effect on the length of the thickened ends. Furthermore, the larger roller stands arranged at the rear stand locations can only have the detrimental effect of slightly increasing the thickness of the longitudinal portions whose walls have already been thickened by the front stands and which consequently have to be cut off in any case. Thus, in the rolling mill in accordance with the invention, the ends which are unavoidably thickened during the stretch-reducing operation are formed virtually only by the front roller stands which build up the tension and which have a small roller diameter and are placed as close together as the roll diameters permit and thus spaced at only short distances apart, thus virtually excluding the disadvantageous effect of the larger roller stands which are spaced at greater distances apart.

The rolling mill in accordance with the invention can be driven in an optional manner by the known drives, i.e. by a group drive and differential drive as well as by a single drive. These drives are all well known in the prior art and accordingly will not be specifically described here.

In the foregoing specification certain preferred practices and embodiments of the invention are set out, however, it will be obvious that this invention may be otherwise embodied within the scope of the following claims.

We claim:

1. In a rolling mill capable of both stretch-reducing tubes having relatively small external diameters and of reducing tubes having relatively large external diameters, which rolling mill comprises a plurality of successive roller stands, some stands having small roll diameters and other stands having large roll diameters, the improvement comprising a complete reversal of the order of the roller stands of a conventional mill capable of both stretch-reducing tubes of relatively small diameter and of and of reducing tubes of relatively large diameter so that the said other roller stands having large roll diameters being arranged in locations which are at the exit end of the rolling mill following the said some stands having small roll diameters.

2. In a rolling mill as claimed in claim 1 wherein the roller stands are spaced as close together as the roll diameters permit.

3. In a rolling mill as claimed in claim 1 wherein the said some stands having small roll diameters are at the entry end of the rolling mill and are closer together in the direction of rolling than are the said other stands having larger diameter rolls.

* * * * *